US005668568A

United States Patent [19]

Holloman

[11] Patent Number: 5,668,568

[45] Date of Patent: Sep. 16, 1997

[54] INTERFACE FOR LED MATRIX DISPLAY WITH BUFFERS WITH RANDOM ACCESS INPUT AND DIRECT MEMORY ACCESS OUTPUT

[75] Inventor: Charles J. Holloman, Fairfield, Conn.

[73] Assignee: Trans-Lux Corporation, Norwalk, Conn.

[21] Appl. No.: 271,096

[22] Filed: Jul. 6, 1994

Related U.S. Application Data

[63] Continuation-in-part of Ser. No. 975,676, Nov. 13, 1992, abandoned.

[51] Int. Cl.[6] ..... G09G 3/32

[52] U.S. Cl. ..... 345/83; 345/200; 348/802

[58] Field of Search ..... 345/82, 83, 185, 345/186, 189, 190, 200, 201; 348/802, 801

[56] References Cited

U.S. PATENT DOCUMENTS

| | | | |
|---|---|---|---|
| 4,412,230 | 10/1983 | Goldberg . | |
| 4,777,485 | 10/1988 | Costello | 345/190 |
| 4,862,154 | 8/1989 | Gonzalez-Lopez | 345/201 |
| 4,897,639 | 1/1990 | Kanayama | 385/82 |
| 4,967,192 | 10/1990 | Hirane et al. | 345/82 |
| 5,134,387 | 7/1992 | Smith et al. | 345/83 |
| 5,153,574 | 10/1992 | Kondo | 348/802 |
| 5,164,715 | 11/1992 | Kashiwabara et al. | 345/82 |
| 5,184,114 | 2/1993 | Brown | 345/83 |

*Primary Examiner*—Steven Saras

*Attorney, Agent, or Firm*—Kane, Dalsimer, Sullivan, Kurucz, Levy, Eisele and Richard, LLP

[57] ABSTRACT

The apparatus is an interface to convert an input analog video signal (real-time) into an output to drive a matrix of light-emitting-diodes. Alternately, a digital video signal can be received, bypassing the analog-to-digital converters. The apparatus is readily configurable to various sizes of matrix sizes and uses a logic board to arrange the data so that low speed components may be used. Two frame buffers alternately receive data in random access order in accordance with the physical and data format of the LED display, and output data by direct memory access methods.

1 Claim, 5 Drawing Sheets

INTERFACE FOR LED MATRIX DISPLAY WITH BUFFERS WITH RANDOM ACCESS INPUT AND DIRECT MEMORY ACCESS OUTPUT

This application is a continuation-in-part of application Ser. No. 07/975,676, filed on Nov. 13, 1992, now abandoned.

BACKGROUND OF THE INVENTION

1. Field of the Invention

This invention pertains to an interface to convert an input analog video signal (real-time) into an output to drive a matrix of light-emitting-diodes wherein the buffers use random access input in accordance with the physical and data format of the display and direct memory access output. One of a pair of buffers receives data by random access so that the data is arranged in the order or sequence in which the output is desired while the other of the pair of buffers outputs data by direct memory access, then the functions reverse. This parallel-like structure and memory technique eliminates the need for separate input and display RAMs.

2. Description of the Prior Art

The use of a multi-color light-emitting-diode (LED) matrix to display moving video-type images is well-known in the prior art. However, prior art displays are limited by the size of image which can be digitally stored in random-access-memory. For example, for a 640 by 400 element LED matrix, with each element displaying three colors at sixteen intensity levels, twelve bits of storage are required for each of the 256,000 pixels being displayed. If this picture were stored in RAM, a one-minute presentation would require 5.53 billion bits of storage if the frames changed only thirty times per second. This is an unrealistic amount of storage, at least in random-access-memory. However, massive read-write analog storage of video signals is economically available from videotape and similar media. Similarly, it may be desirable, in real-time, to convert an input analog video signal (such as an input to a television or a personal computer screen) into a digital signal to drive an LED display matrix. It is desirable for such an apparatus to be easily adaptable to various sizes of LED display matrices and to various input requirements configurations.

While the same result has been achieved by television studio apparatus, the television studio apparatus requires very fast components (well in excess of 40 megahertz). This has made the prior art equipment very expensive.

Additionally, some proposed prior art solutions, such as U.S. Pat. No. 5,184,114 to Brown have relied on the use of separate input and display RAMs with data distributed or parsed out from the input to the display RAMs using a shift register approach. Such devices may be difficult to implement satisfactorily due to fundamental constraints with regard to speed, synchronization and matrix size.

Additionally, some primitive prior art used color sequential output and did not provide for the simultaneous display of colors. Additionally, this primitive prior art was limited to the display of two intensity levels for each pixel. That is, the colors within a pixel could not have their color intensity changed individually.

OBJECTS AND SUMMARY OF THE INVENTION

It is therefore an object of this invention to provide an apparatus to convert an input analog video signal into a digital signal to drive a multi-color LED matrix display or other discrete pixel oriented displays.

It is therefore a further object of this invention to provide an apparatus which will perform such a conversion in real time.

It is therefore a further object of this invention to provide an apparatus with substantially simultaneous color readout.

It is therefore a still further object of this invention to provide an apparatus which can vary the intensity of each color of a multiple color pixel.

It is therefore a still further object of this invention to provide such an apparatus which is re-configurable to various sizes of LED matrix displays and to various input configurations.

It is therefore a still further object of this invention to provide direct memory access output to an interface for an LED matrix display.

It is therefore a still further object of this invention to eliminate the need for separate input and display RAMs.

It is therefore a final object of this invention to provide such an apparatus using relatively low-speed electronics at a low cost.

These and other objects are attained by providing an apparatus which uses the red, green and blue analog signal interface between a typical personal computer and the display monitor (or, as stated above, receives equivalent data from an analog video source) and stores the digital data in one of two RAM buffers which stores only one screen. One RAM buffer is used to record the data while the second outputs the data to the LED matrix display. An analog-to-digital (four bit) converter is used for each color to be displayed. The use of multiple analog-to-digital convertors allows for parallel processing which reduces the speed requirements for the individual components. The apparatus uses only low-cost common electronic components operational at rates under 40 megahertz.

The single frame of memory is arranged into several smaller segments so that each smaller segment can output its data to the screen in parallel which keeps the data transfer rate low for any individual component.

A static video RAM array is divided into two buffers. Video data is loaded into a first buffer in random access sequence (so that the data is arranged in its output order or sequence thereby allowing direct memory access output) while data is being output from a second buffer of the static RAM array using direct memory access techniques. Then the functions of the buffers reverse. This parallel-like structure and memory technique allow the static RAM array to perform both the data storage function and the refresh function of the output.

LEDs typically are On-Off devices. In order to display different varying intensities of color, the apparatus subdivides the active picture time, and activates the LEDs for a period less than the active picture time to achieve an intensity less than the maximum. The apparatus uses four bits data in storage sequentially for each pixel with the least significant bit representing one unit of time, the next least significant bit representing two units of time, the next most significant bit representing four units of time, and the most significant bit representing eight units of time. This provides for 15 display intensity levels (plus black) and requires a transfer rate of 240 frames per second. Some display devices require the red and green data to be supplied simultaneously other others require the colors sequentially. The preferred embodiment of the apparatus provides for the data to be stored in its RAM for color interleaving by pixel or by frame. Likewise, some display systems require the display data to be loaded, then displayed while more efficient systems accept new display data while the prior data is being displayed, then transfer the new data for display without dead-time, thereby providing for a brighter display. The logic of the apparatus allows many variations in data display without re-designing the memory or data transfer systems for each application.

The flexibility of the apparatus is achieved with the aid of the following elements:

1. Simple analog to digital converters for each color.
2. The routing of colors into RAM as required for maximized display efficiency.
3. A programmable counter structure which stores the data in RAM locations for maximized output.
4. Settable counters for variable display size.
5. A control ROM which customizes the logic for a unique display face.
6. A programmable counter structure for data readout to allow for 8-bit RAMS to function as 16-bit storage structures which are used for simultaneous color displays.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
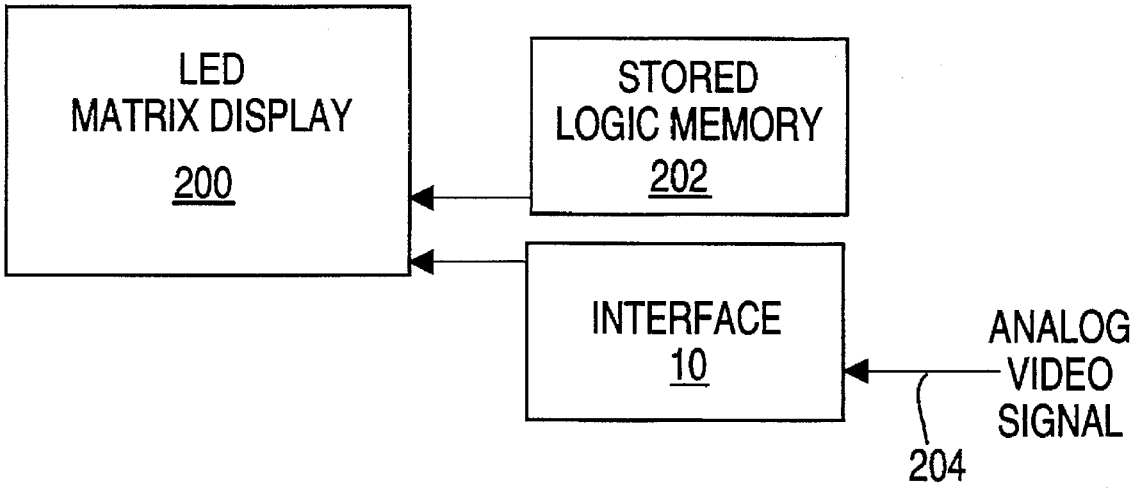
FIG. 1 is a schematic of the environment in which the apparatus of the present invention operates.

Referring now to the drawings in detail wherein like numerals refer to like elements throughout the several views, one sees that FIG. 1 is a schematic of the environment in which the interface of apparatus 10 operates. LED matrix display 200 (the LEDs preferably being either two or three colors) can receive stored digital input driving information from stored logic memory 202 in a conventional manner. As those skilled in the art will realize, LED matrix display 200 can be replaced with other discrete pixel oriented displays.

LED matrix display 200 can receive information from apparatus 10 of the present invention which is receiving an analog video input on line 204.

Figure 2:
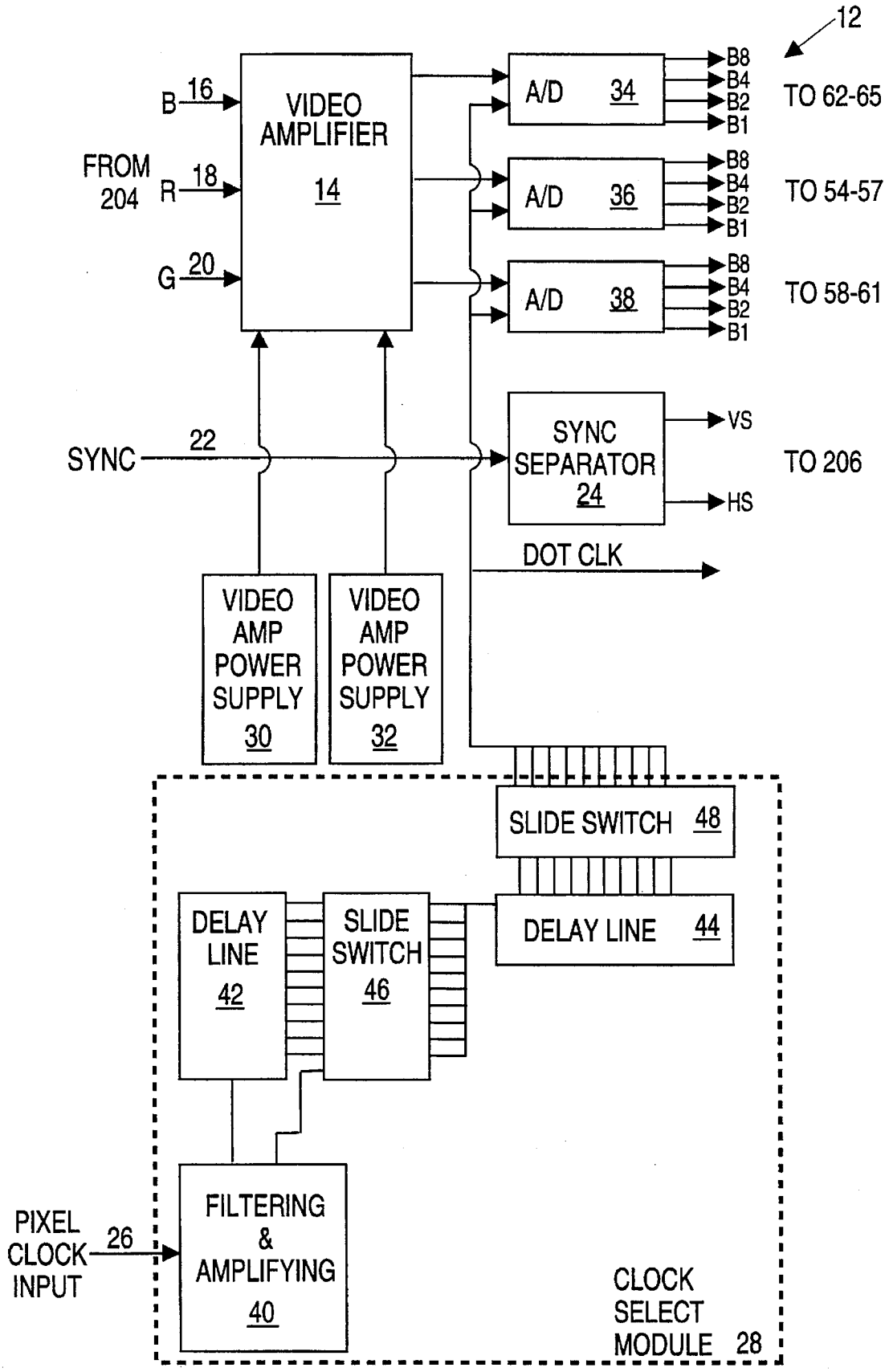
FIG. 2 is a schematic of the input section of the interface random-access-memory of the present invention.

FIG. 2 is a schematic of the input section 12 of the interface random-access-memory of apparatus 10. Input section 12 provides the analog to digital signal capture and processing function of apparatus 10.

Input section 12 includes video amplifier 14 which includes blue input 16, red input 18, and green input 20. Similarly, composite sync input 22 is input to sync separator module 24 which provides a horizontal sync output (HS) and a vertical sync output (VS). Additionally, pixel clock input 26 (which is obtained from the data source or derived from the input analog video signal using a phase-locked loop clock recovery system 'not shown') is received by clock select module 28. Inputs 16, 18, 20, 22, 26 are received from line 204 (FIG. 1) and are typically received from a personal computer (not shown) and are typically between 0.0–0.7 volts. Additional apparatus well-known in the prior art may be required to divide an input analog signal into signals 16, 18, 20, 22, and 26.

Video amplifier 14 receives its power from video amplifier power supply 30. Additionally, video amplifier 14 receives a voltage offset, from analog-to-digital voltage offset module 32. Video amplifier 14 amplifies inputs 16, 18, 20 and sends the amplified input to analog-to-digital converters 34, 36, 38. Analog-to-digital converter 34 provides digitized values (bits) of the blue signal—B8 (most significant), B4, B2, B1 (least significant). Similarly, analog-to-digital converter 36 provides digitized values (bits) of the red signal—R8 (most significant), R4, R2, R1 (least significant). Analog-to-digital converter 38 provides digitized values (bits) of the green signal—G8 (most significant), G4, G2, G1 (least significant). Analog-to-digital converters 34, 36, 38 provide the respective data in synchronization with the clock signal (Dot Clk) provided by clock select module 28.

Figure 3:
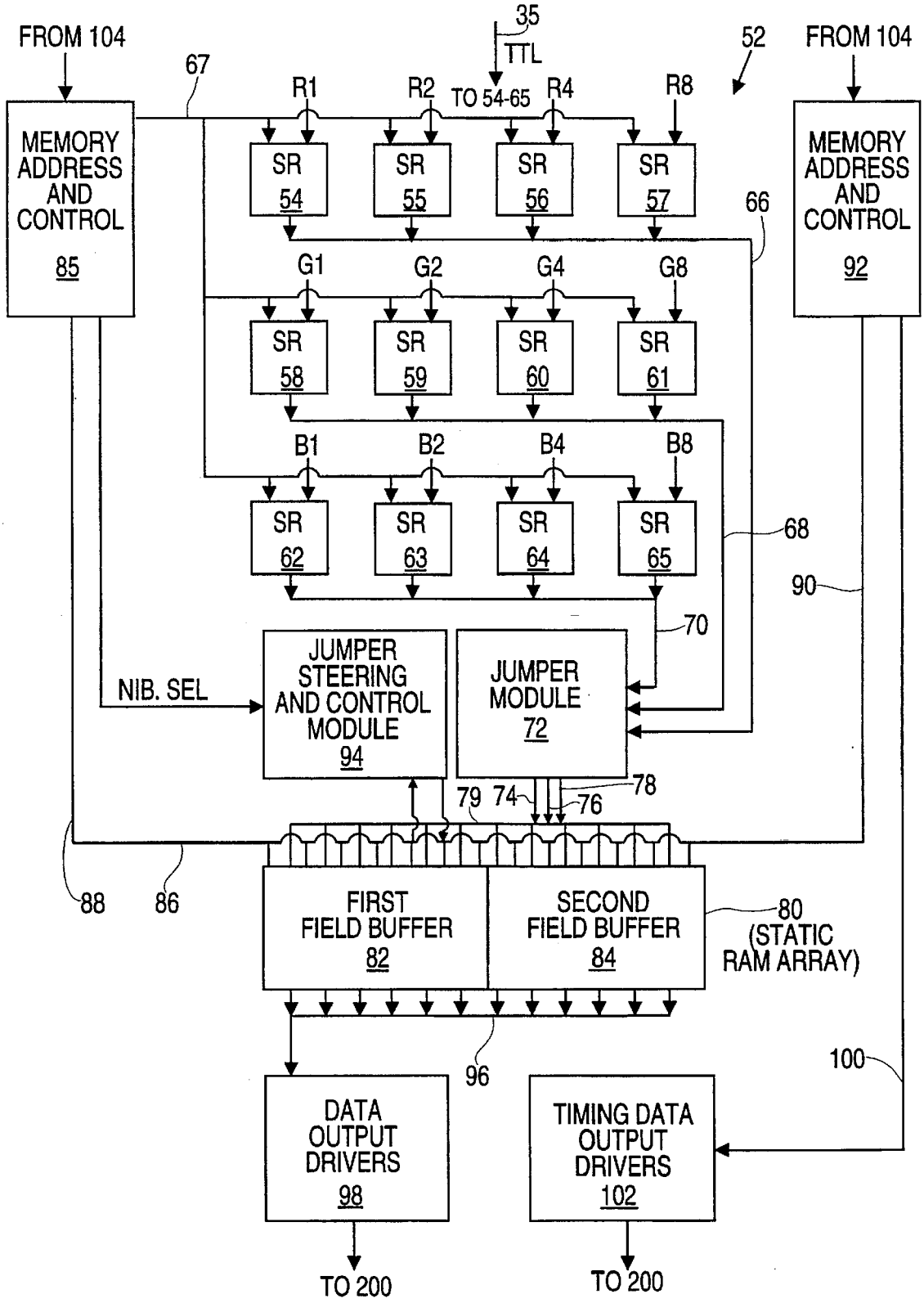
FIG. 3 is a schematic of the processing section of the interface random-access-memory of the present invention.

Additionally, as shown in FIG. 3, analog-to-digital converters 34, 36, 38 can be bypassed via line 35 to receive direct digital inputs, such as TTL (e.g., CGA input).

As previously described, clock selector module 28 receives pixel clock input 26. Clock selector module 28 includes filtering and amplifying module 40. Clock selector module 28 further includes delay lines 42, 44 (which include a series of five nanosecond delay buffers) in communication with selectors (slide switches) 46, 48, respectively. Clock selector module generates the output Dot Clk signal (which is also used by analog-to-digital converters 34, 36, 38) which has the optimum timing with respect to the input video signal.

Referring now to FIG. 3 which discloses the processing section 52 of the interface RAM, shift registers 54, 55, 56, 57, serving as serial-to-parallel converters, receive the R1, R2, R4, R8 signals, respectively. Similarly, shift registers 58, 59, 60, 61 receive the G1, G2, G4, G8 signals, respectively, and shift registers 62, 63, 64, 65 receive the B1, B2, B4, B8 signals, respectively. Shift registers 54–65 are controlled by the RCLK, SCLK, OE1, OE2, OE4 and OE8 (clock and output enable) signals from the logic board 104 of FIG. 4 via control bus 67. Shift registers 54–57 output parallel (red pixel) data to bus 66, shift registers 58–61 output parallel (green pixel) data to bus 68 and shift registers 62–65 output parallel (blue pixel) data to bus 70. Busses 66, 68, 70 communicate with jumper module 72 which is variably configured to direct the data from busses 66, 68, 70 onto busses 74, 76, 78 and, in turn, onto data bus 79, in order to provide the capability of separate or interleaved storage in static RAM array 80. Static RAM array 80 is divided into first field buffer 82 and second field buffer 84. First field buffer 82 receives data while second field buffer 84 provides output data, and vice versa. Field buffers 82, 84 each include an array of RAM chips (not shown) wherein the red, green and blue storage can be separate or intermixed depending upon the strap configuration in jumper module 72. The RAM chips in first field buffer 82 receive timing and control commands from timing and control bus 86 which, via bus 88, is in communication with first memory address and control module 85 which is, in turn, in communication with the logic board 104 of FIG. 4. Likewise, the RAM chips in second field buffer 84 receive timing and control commands from timing and control bus 86 which, via bus 90, is in communication with second memory address and control module 92 which is, in turn, in communication with the logic board 104 of FIG. 4.

Timing and control bus 86 further receives output steering control information from output steering control module 94 and provides this information to the output enable inputs of the RAM chips in static RAM array 80. Output steering and control module 94 is responsive to first memory address and control module 85.

The memory address and control modules 85 and 92, the jumper module 72 and the jumper steering and control module 94 are configured to input data alternately into field buffers 82, 84 by random access methods in the order or sequence for output in accordance with the physical format and data format of the LED matrix display 200 so that the data can be read out by direct memory access methods.

First field buffer 82 receives data using random access memory methods while second field buffer 84 is outputting data to data bus 94 using direct memory access methods. Then second field buffer 84 receives data using random access memory methods while first field buffer 82 is outputting data to data bus 94 using direct memory access methods. This parallel-like configuration and memory technique allow the field buffers 82, 84 to perform both the data storage and refresh functions without the need for separate input RAMs and display RAMs.

The RAM chips of static RAM array 80 provide data by direct memory access to output data bus 96 which, in turn, provides the output data to data output drivers 98 which drive LED matrix display 200. Simultaneously, output timing bus 100 receives output timing data from second memory address and control module 92. This output timing data is provided to timing output drivers 102 and thereby provided to LED matrix display 200.

Figure 4:
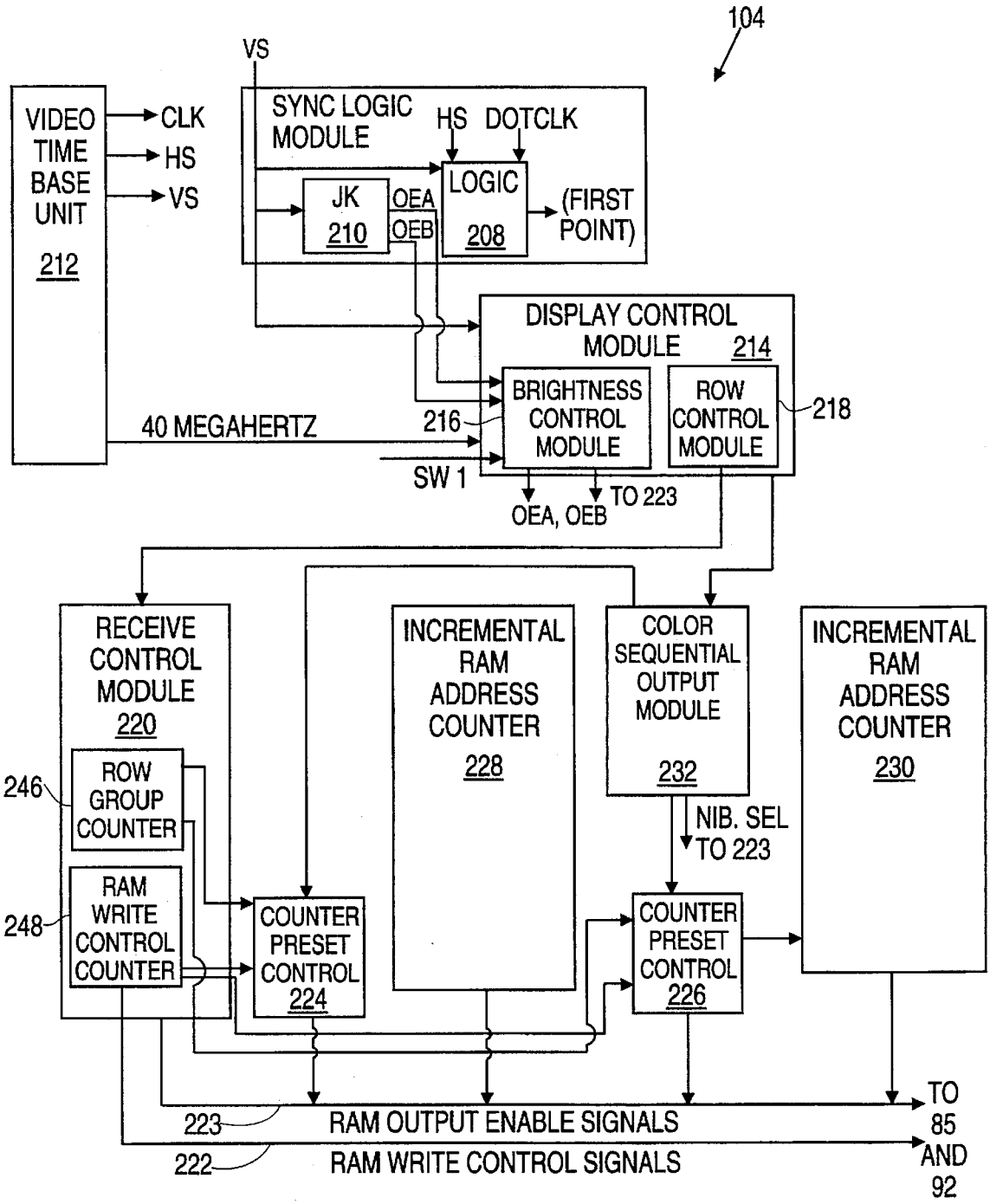
FIG. 4 is a schematic of the logic board of the present invention.

Referring now to FIG. 4 which discloses the logic board 104 of apparatus 10, sync logic module 206 receives the vertical sync (VS), horizontal sync (HS) and Dot Clk (which is used as the clock signal for logic board 104) signals from the input section 12 of the interface RAM. Sync logic module 206 includes logic 208 which uses the synchronization signals to coordinate the data with the first (typically the uppermost and leftmost) point on LED matrix display 200. Sync logic module 206 further includes J-K flip-flop 210 keyed to the vertical sync (VS) signal to provide OE A (output enable A) and OE B (output enable B) signals to output steering control module 94 (FIG. 3) via first memory address and control module 85 in order to determine which of first field buffer 82 or second field buffer 84 is to receive input data while the other provides output data.

Video time base unit 212 provides a 40 megahertz signal, an internal clock (INT-CLK) signal, an internal horizontal sync signal (INT-HS), and an internal vertical sync signal (INT-VS). Typically, however, jumpers (not shown) within sync logic module 206 are configured so as to choose the external horizontal and vertical sync signals, respectively, over the internal horizontal and vertical sync signals.

Display control module 214 receives the 40 megahertz signal from video time base unit 212 and vertical synchronization data from sync logic module 206 and generates (ROM-based) brightness (or intensity) control data signals via brightness control module 216, both on an individual pixel basis and for the entire image. Display control module 214 further includes row control module 218 to generate row control signals which are used to direct the data to specific rows in LED matrix display 200 (see FIG. 1). Brightness control module further receives OE A and OE B (output enable) signals from J-K flip-flop 210 and transmits these and other control signals to bus 223 as shown in FIG. 4.

Receive control module 220 receives data from row control module 218 and from sync logic module 206 (such as the vertical sync, the horizontal sync, and the Dot Clk signal) and generates RAM write control signals which are sent to the processing section 52 of the interface RAM via bus 222 and first and second memory address and control modules 85, 92 (see FIG. 3). Similarly, RAM output enable signals are generated and sent along bus 223.

Receive control module 220 further drives first counter preset control module 224 and second counter preset control module 226. First and second preset counter modules 224, 226 drive first and second incremental RAM address counters 228, 230, respectively. First incremental RAM address counter 228 is shown in greater detail in FIG. 5.

The structure of incremental RAM address counters 228, 230 provides for the image data to be written into RAM array 80 at 60 frames per second so that it may be transferred to a display face at a minimum of 240 frames per second while using low cost HC series CMOS components operating below 40 megahertz. The input pixel rate is limited to about 25 megahertz with the commercial components used so that each color component (red, green and blue) is processed in parallel, and converted to an eight-bit byte so that the intensity level can be stored as four bytes in RAM array 80 in rapid sequence.

The images to be displayed are formed with a single stream of data (typically scanning from left to right, and from top to bottom). In contrast to CRT images which are formed by CRT phosphors which have a slow decay time thereby causing the entire image to appear simultaneously to the eye, the LEDs which form the images of the present invention are very fast and turn off immediately. Therefore, the eye and the mind provide the only image integration. The brightness of the image on the LED field increases when the LED is kept on so it is important to keep the LED on as long as possible. The image flicker frequency is longer when the display turns off so fast, the images must be presented at 120 frames per second or faster to eliminate the display flicker. When scanning used to share LED drivers, it must be kept to less than ten percent to keep the image bright while reducing the flicker. This requires that the data be organized in RAM array 80 so it may be transferred to the display face as rapidly as possible. In practice, the display face is divided in groups of 64 lines, and 8 lines of LEDs are activated within each 64 line group at the same time. Each of the 64 line groups are activated simultaneously. The line length typically stores 41 bytes of 8 bit image data for 328 pixels per line and 64 lines for each memory group.

Counter preset control modules 224, 226 and incremental RAM address counters 228, 230 further receive driving signals from color sequential output module 232, which, in turn, receives driving signals from display control module 214.

Figure 5:
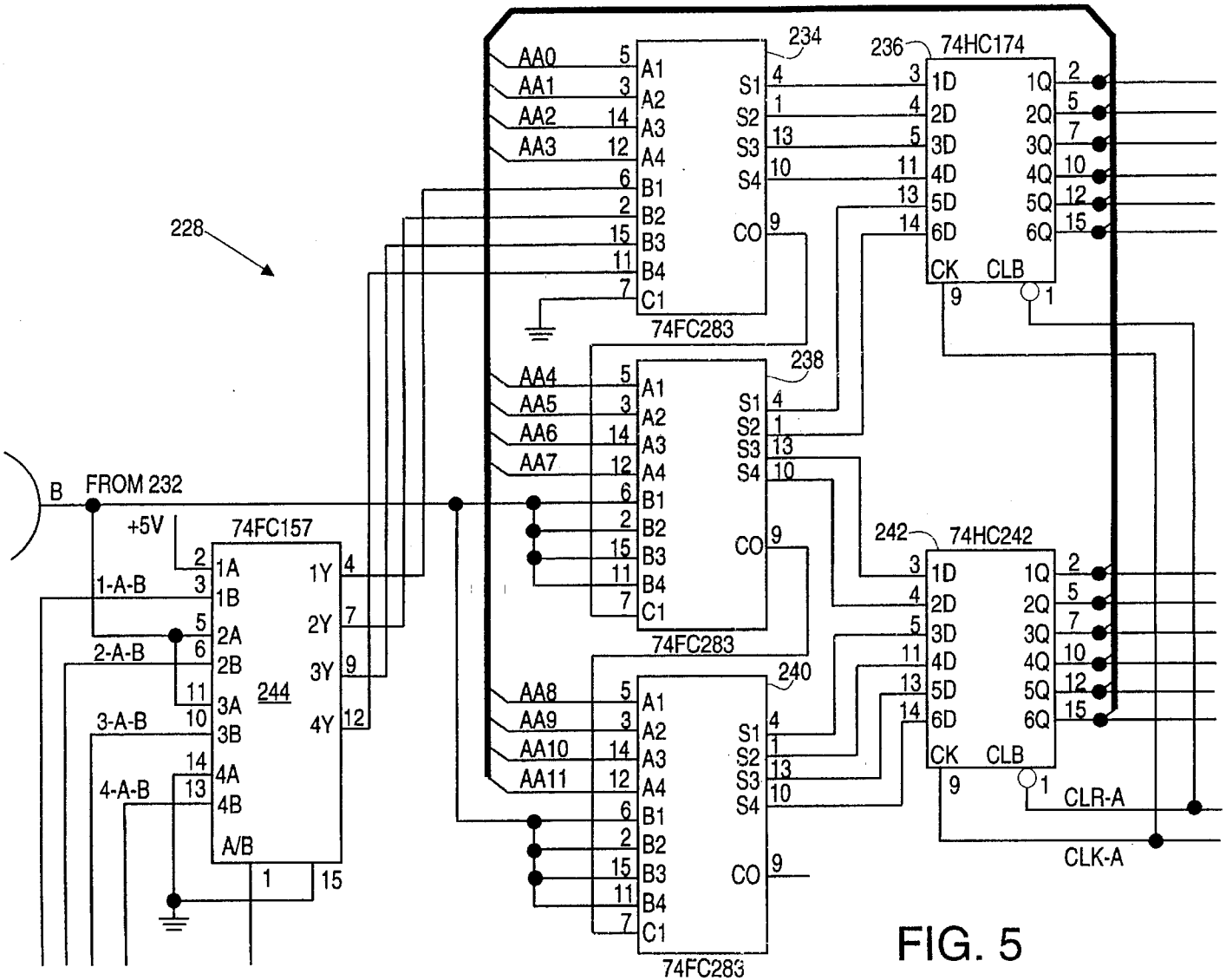
FIG. 5 is a schematic of the incremental counter of the logic board of the present invention.

As shown in FIG. 5, incremental RAM address counter 228 includes two 6 bit latches, 236, 242, with their outputs routed through three 4-bit adders 234, 238, 240, so that any constant can be added to an existing count to provide RAM address bits A0 through A11. RAM address bits A12 and A13 are used to store either the four intensity bits or the red-green-blue color bits in four sections of RAM array 80 as controller by counter preset control module 224 and receive control module 220. When image data is written into RAM array 80, selector 244 routes the counter increment component to counter preset control 224. Because eight lines of data will be read out simultaneously, the first line of image data is stored in every eighth RAM address, starting from 00 with the counter system incremented by a clock signal with eight added until the first eight lines of data have been stored through RAM address 2623. RAM address latches 236 and 242 are then cleared with CLR-A which is derived by the horizontal sync pulse HS after each eighth line, and the row group counter 246 is advanced from 0 to 1. The Row Group address is loaded into elements 234–242 through selector 244 and counter preset control module 228 and the next eight lines of image data are stored in RAM address 1 through 2624 in eight count increments. This cycles continues until the entire 64 lines are stored in RAM address 0 through 2630 at which point the RAM write control counter 248 is incremented from zero to one, and the next RAM group is activated to store the next 64 lines of image data. The memory bank may typically be fitted with three RAM groups capable of storing 192 lines of image data, with each line including 328 pixels. Additional RAM groups are provided for storing larger images. The vertical synchronizing pulse VS indicates the end of one complete frame of data and switches the memory bank from storage mode to display mode under control of flip-flop 210.

In other words, like order elements of each group of eight lines are stored consecutively (that is, the first byte of the first group is stored at location 0, the first byte of the second group is stored at location 1, the first byte of the third group is stored at location 2, and so forth through location 7, then the second byte of the first group is stored at location 8, the second byte of the second group is stored at location 9, and so forth).

The incremental RAM address counter 228 is then configured to increment by a count of one for each CLK-A signal from counter preset control 224. Eight bytes of data are loaded from each RAM group into the display with eight A-SET-LD (generated by display control module 214) pulses, and shifted into position with 8 A-SR-CLK (also generated by display control module 214) pulses. Only one intensity level is processed at this time. If only one color is to be displayed at a time, this process repeats 40 times until the first 41 bytes or 328 single color pixel data has been loaded into the eight lines which represent the first of the eight rows to be scanned. The LEDs of the LED matrix display 200 are turned on for one specified time period, then the cycle is repeated seven more times until all eight groups of eight lines or sixty-four lines of the first color at the highest intensity have been displayed. The entire cycle repeats for the second color. The combined cycle is repeated for the next intensity level with its LED display time halved for each successive cycle thereby providing a total of sixteen intensity levels. The brightness control module (ROM) 210 controls the intensity process as will be described herein.

When the colors are to be presented to LED matrix display 200 simultaneously for each pixel to eliminate color aberrations, the color data must be transferred to display 200 in sequence which requires triple the data transfer prior to display. This is accomplished by intermixing the image color data into the RAM array 80 with RAM addresses A12 and A13. The image data is stored in RAM array 80. When incremental RAM address counter 228 is configured to display the image data, it is incremented eight times to transfer and shift into position the first byte of 8 bits for the first color (e.g., red, with A12=A13=0), then counter 228 is decremented 8 counts by adding a nines complement constant into the address adder under the control of color sequential output module 232, bit latches 234, 238, 240, and selector 244. The next color byte (e.g., green, A12=1, A13=0) is then transferred from the same RAM address but from a second section of RAMs under control of addresses A12 and A13 of the output selector (bit latch) 224 and the NIB-SEL lead (generated by color sequential output module 232 which receives input from display control module 214) and the counter 228 is decremented by eight counts again. Finally, the third color (e.g., blue, A12=0, A13=1) is then transferred and counter 228 is allowed to advance to the next RAM address to repeat the process. The display load and shift sequence continues for a total of 123 times transferring 984 bytes of image data for each line, 328 for each of the three colors. The cycle repeats until the entire field has been displayed at each of the four intensity levels as described previously.

Alternately, a two-color sequential mode may be used wherein the first color at its highest intensity, followed by the second color at its highest intensity, followed by the first color at its next highest intensity, etc. is presented until each intensity level has been presented for display. Similarly, a two-color (such as red and green) simultaneous mode may be used wherein each display byte contains four bits of the first color data and four bits of the second color data intermixed to form one sub-byte. Two sub-bytes must be transferred to the display 200 prior to presentation. Eight sub-bytes are first sent to display 200, then RAM address counter 228 is decremented by 8 counts and a second eight sub-bytes are transmitted under control of NIB-SEL. Display control module 214 selects the intensity level using A12 and A13. RAM address counter is allowed to advance. The process continues until all intensity levels have been presented for display.

NIB-SEL is used when more than one color is to be displayed at one time and is not required when the colors are displayed sequentially.

When LED matrix display 200 requires 70 lines of pixels with 7 lines activated in each section at one time, incremental RAM address counter 228 is configured to increment and decrement in 10 counts rather than the previously described 8 counts.

Brightness control module 210 provides the controls to output one complete frame of image data to the display face each time it is activated at the end of each vertical synchronizing pulse VS. It stops itself after a complete frame has been presented when a "1" is latched in its control output. Three latched outputs direct the image data into the appropriate line of one of the 7 or 8 lines of LEDs to be activated. Additional latched outputs are used both to provide the RAM address A12 and A13 and the duration of LED activation. Brightness control SW 1 (input to brightness control module 216 as shown in FIG. 4) selects the overall brightness of display 200 in 8 logarithmic steps while the image intensity data adjusts these display periods to pixel intensity. The following table is an example of how the LED brightness is adjusted over a 180 to 1 range.

If the brightest LED is to be activated for 192 ROM clock periods and is halved for each of the four display periods, and is adjusted in 8 steps by the overall brightness control, the display periods are as follows:

| OVERALL BRIGHTNESS | DISPLAY PERIOD FROM RAM A12, A13 | | | |
|---|---|---|---|---|
| STEP | FULL | HALF | QTR | EIGHTH |
| 0 | 192 | 96 | 48 | 24 (360 Max) |
| 1 | 136 | 68 | 34 | 17 |
| 2 | 96 | 48 | 24 | 12 |
| 3 | 68 | 34 | 17 | 9 |
| 4 | 48 | 24 | 12 | 6 |
| 5 | 34 | 17 | 9 | 4 |
| 6 | 24 | 12 | 6 | 3 |
| 7 | 17 | 9 | 4 | 2 (2 Min) |

The combination of the programmable counter system for controlling the RAM storage and readout, and the ROM for controlling display position and brightness provides a display system capable of accommodating many different display faces without redesigning the display interface.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. An apparatus for representing a video image on an LED matrix display having N lines and n pixels per line, N and n being sufficiently large to represent said video image, said image being derived from an analog video signal, the apparatus comprising:

means for receiving a digital video signal;

serial-to-parallel conversion means for converting said digital video signal into bytes of data;

memory means including a first and a second buffer for receiving said bytes;

logic means for inputting said data to said memory means in random access order so that a frame includes M groups of m consecutive lines, wherein like order data from each of said M groups is stored in M consecutive bytes in said memory means and further so that data is stored in an order which the data is to be output from said memory means, thereby implementing direct memory access of said memory means, said logic means further including means for outputting data from said memory means to output means, wherein like order data from each of said M groups is directed to said output means substantially simultaneously;

means for independently varying an intensity of each color component of each pixel stored as said data in said memory means;

said logic means alternately inputting data to said first buffer while outputting data from said second buffer and subsequently inputting data to said second buffer while outputting data from said first buffer, wherein said memory means performs both a data storage function and a refresh function;

said means for receiving, said conversion means, said memory means and said logic means operating at speeds sufficient to sustain a video image on the LED matrix display;

wherein said means for receiving a digital video signal includes means for receiving components of an analog video signal, said components including color components and synchronization signals; and analog-to-digital conversion means for converting said color components into digital values;

wherein said first and second buffers exchange operations responsive to a flip-flop means in said logic means responsive to said vertical synchronization signal;

wherein said logic means is configurable to a plurality of output configurations, said logic means further including a row group counter means responsive to said horizontal synchronization signal, counter control means responsive to said row group counter means, and incremental counter means responsive to said counter control means; and wherein said incremental counter means includes latching means and adder means, wherein said adder means are incremented by M in response to clock signals during receiving operations until a group of m lines is stored in said memory, then said latching means is cleared and said row group counter means is incremented by one, and wherein said latching means and said adder means are incremented by one in response to clock signals during transmitting operations and like order data from each of said M groups is transmitted from M consecutive bytes in said memory means.

* * * * *